United States Patent [19]

Rodenberger et al.

[11] 4,449,587

[45] May 22, 1984

[54] SURFACE CONTROLLED SUBSURFACE SAFETY VALVES

[75] Inventors: Charles M. Rodenberger, Carrollton; Phillip S. Sizer, Dallas, both of Tex.; Kevin C. O'Malley, Mar Vista, Calif.

[73] Assignee: Otis Engineering Corporation, Dallas, Tex.

[21] Appl. No.: 456,333

[22] Filed: Jan. 6, 1983

[51] Int. Cl.[3] ..... E21B 34/10

[52] U.S. Cl. ..... 166/323; 166/332

[58] Field of Search ..... 166/332–334, 166/323, 319, 321, 324; 251/354

[56] References Cited

U.S. PATENT DOCUMENTS

| | | | |
|---|---|---|---|
| 3,694,868 | 10/1972 | Taylor, Jr. | 166/315 |
| 3,786,865 | 1/1974 | Tausch et al. | 166/323 |
| 3,845,818 | 11/1974 | Deaton | 166/322 |
| 3,882,935 | 5/1975 | Calhoun | 166/322 |
| 4,273,186 | 6/1981 | Pearce et al. | 166/324 X |
| 4,276,937 | 7/1981 | Calhoun et al. | 166/323 |
| 4,344,602 | 8/1982 | Arendt | 166/323 X |
| 4,356,867 | 11/1982 | Carmody | 166/373 |

*Primary Examiner*—James A. Leppink
*Assistant Examiner*—Thuy M. Bui
*Attorney, Agent, or Firm*—Thomas R. Felger

[57] ABSTRACT

Lock-open mechanism for surface controlled subsurface safety valves. A lock-open sleeve can be positioned by wireline techniques to hold open the valve closure means for a subsurface safety valve. The operating tube of the safety valve can be used to return the valve closure means to normal operations. One embodiment of the present invention is particularly useful as a well tool which can readily be attached to the lower portion of presently available flapper type safety valves. Alternative embodiments of the present invention can be built into both ball type and flapper type safety valves as an integral part of the complete safety valve assembly.

17 Claims, 15 Drawing Figures

SURFACE CONTROLLED SUBSURFACE SAFETY VALVES

BACKGROUND OF THE INVENTION

1. Field of the Invention

The present invention relates to surface controlled subsurface safety valves used in the oil and gas industry and means for locking such valves in their open position.

2. Description of the Prior Art

The following U.S. patents disclose various inventions for locking surface controlled subsurface safety valves both temporarily and permanently in their open position:

U.S. Pat. Nos. 3,696,868; 3,882,935; 4,273,186; 4,276,937 and 4,344,602.

The present invention is particularly useful for temporarily locking open surface controlled subsurface safety valves having flapper type valve closure means such as shown in U.S. Pat. No. 3,845,818 to Thomas M. Deaton. This patent is incorporated by reference for all purposes within this application.

SUMMARY OF THE INVENTION

The present invention discloses a well tool for locking open the valve closure means of a surface controlled subsurface safety valve, comprising housing means with a longitudinal passageway extending therethrough; means for attaching the housing means to the safety valve below its valve closure means; a lock-open sleeve slidably disposed in the longitudinal passageway having a first position which does not affect operation of the valve closure means and a second position which holds the valve closure means in its open position; means for releasably securing the lock-open sleeve in its first position; and means for biasing the lock-open sleeve to shift from its first to its second position.

One object of the present invention is to provide a well tool which can be attached to any flapper type subsurface safety valve and allow the safety valve to be temporarily locked open.

Another object of the present invention is to provide a surface controlled subsurface safety valve in which the operating tube for the valve closure means can unlock the valve closure means after being temporarily locked in its open position.

A further object of the present invention is to provide a surface controlled subsurface safety valve which can be locked open and returned to its unlocked position as frequently as desired for the existing well conditions.

Additional objects and advantages of the present invention will become readily apparent to those skilled in the art from studying the following written description in conjunction with the drawings and claims.

DESCRIPTION OF THE PREFERRED EMBODIMENTS

Figure 1:
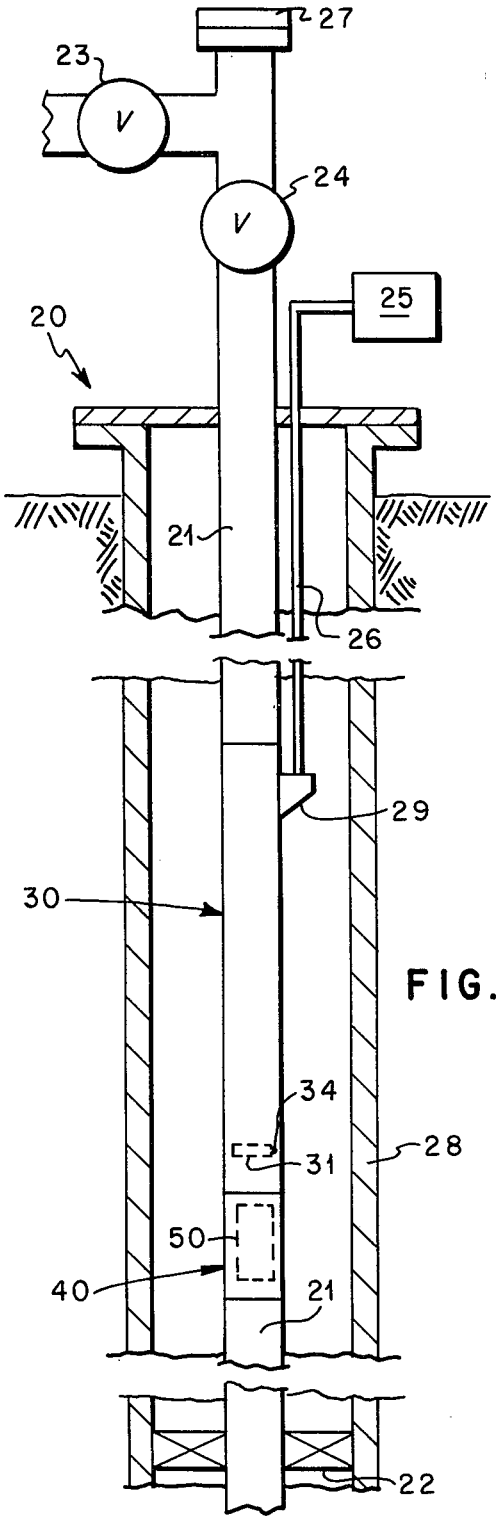
FIG. 1 is a schematic drawing in elevation with portions broken away showing a typical well completion having a surface controlled subsurface safety valve incorporating the present invention.

A typical well completion 20 is shown in FIG. 1. The well bore is defined by casing string 28 which extends from the well surface to the hydrocarbon producing formation (not shown). Tubing or well flow conductor 21 is disposed within casing string 28. Production packer 22 directs formation fluid which enters casing 28 through perforations (not shown) to the well surface via tubing 21. Valves 23 and 24 control fluid flow from tubing 21 at the well surface. Wellhead cap or flange cover 27 is provided at the well surface to allow servicing of well 20 by conventional wireline techniques. Such servicing includes the installation and removal of flow control devices from within tubing 21 and bottom hole temperature and pressure surveys.

Surface controlled subsurface safety valve 30 is installed as part of tubing 21 to prevent undesired fluid flow to the well surface. Control line or conduit 26 extends from hydraulic manifold 25 at the well surface to boss 29 and directs control fluid to safety valve 30. Hydraulic manifold 25 includes the pumps, reservoir, accumulators and control valves normally associated with a surface controlled subsurface safety valve. U.S. Pat. No. 3,845,818 discloses one type of surface controlled subsurface safety valve which can be used with the present invention.

Safety valve 30 has a flapper type valve closure means 31 which can be positioned to block undesired fluid flow therethrough. Well tool 40 with lock-open sleeve 50 disposed therein is located below valve closure means 31. Lock-open sleeve 50 has a first position which does not affect operation of valve closure means 31 and a second position which holds valve closure means 31 in its second or open position. An important feature of the present invention is that lock-open sleeve 50 directly contacts and traps valve closure means 31 in its open position. In FIG. 1 valve closure means 31 is shown by dotted lines in its first or closed position blocking upward fluid flow through tubing 21. Lock-open sleeve 50 is also shown by dotted lines in its first position. The design and operation of valve closure means 31, well tool 40, and lock-open sleeve 50 will be described in detail.

Figure 2:
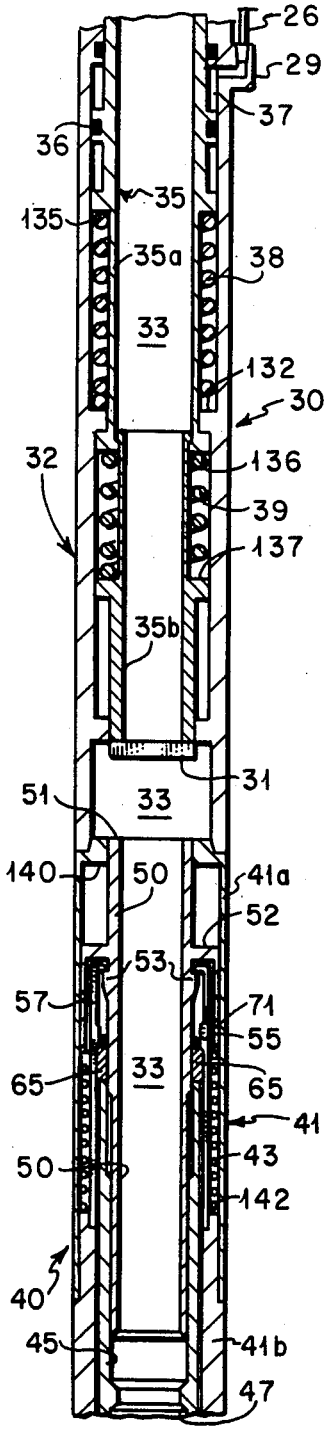
FIG. 2 is a schematic drawing in longitudinal section with portions broken away showing a surface controlled subsurface safety valve with the valve closure means in its first position blocking fluid flow therethrough.
Figure 3:
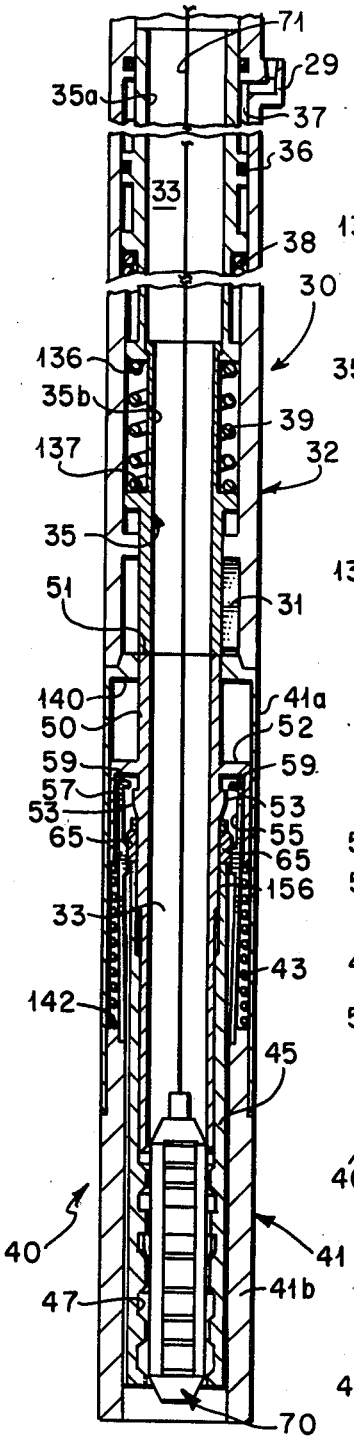
FIG. 3 is a schematic drawing in longitudinal section with portions broken away showing the safety valve of FIG. 2 with the valve closure means in its second position allowing fluid flow through the safety valve.
Figure 4:
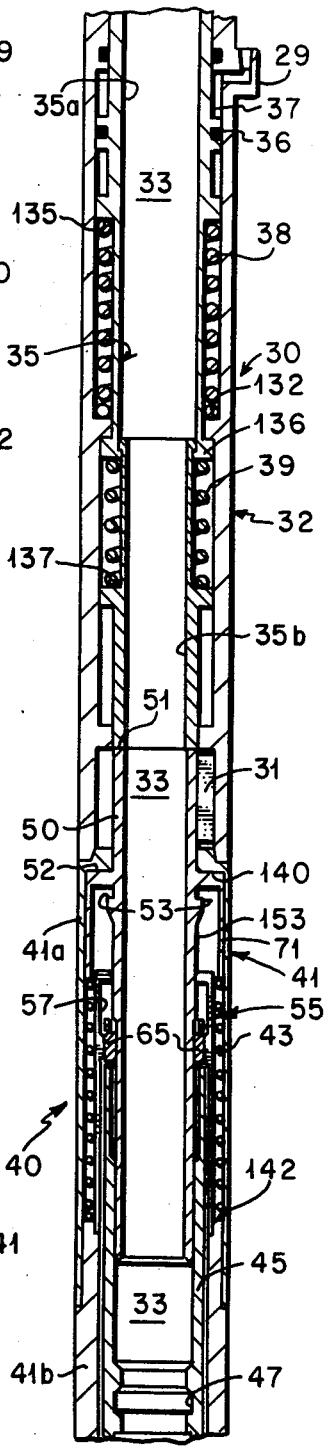
FIG. 4 is a schematic drawing in longitudinal section will portions broken away showing the safety valve of FIG. 2 with the valve closure means releasably locked in its second position.

A schematic representation of safety valve 30 with well tool 40 attached thereto for locking open valve closure means 31 is shown in FIGS. 2, 3 and 4. Safety valve 30 is defined by housing means 32 with longitudinal passageway 33 extending therethrough. Valve closure means 31 comprises a flapper mounted on hinge 34 (not shown in FIGS. 2, 3, and 4) within longitudinal passageway 33. In FIG. 2 valve closure means 31 is in its first position blocking fluid flow to the well surface through longitudinal passageway 33. In FIGS. 3 and 4 valve closure means 31 is shown in its second position allowing fluid flow through longitudinal passageway 33.

Operating tube means 35 is slidably disposed within housing means 32 and partially defines longitudinal passageway 33. Operating tube means 35 is used to move valve closure means 31 from its first position to its second position. For the particular safety valve 30 shown in FIGS. 2, 3 and 4, operating tube means 35 has two concentrically aligned subsections **35*a* and 35*b*. Piston means 36 is carried on the exterior of subsection 35*a* and partially defines variable volume chamber 37. Suitable openings and flow paths are provided through lug 29 and housing means 32 to allow control fluid to communicate between control line 26 and variable volume chamber 37. Increased fluid pressure in chamber 37 acts on piston means 36 causing operating tube subsection 35*a* to slide longitudinally in one direction towards valve closure means 31. Spring 38 is disposed around the exterior of subsection 35*a* between shoulder 135 on subsection 35*a* and shoulder 132 within housing means 32. Spring 38 biases subsection 35*a*** to move longitudinally in the other direction.

If a differential pressure above a preselected level is present across valve closure means 31, subsections **35*a* and 35*b* cooperate to protect valve closure means 31. Subsection 35*a* is sized to telescope within subsection 35*b*. Spring 39 is disposed around the exterior of subsection 35*b* between extreme end 136 of subsection 35*a* and shoulder 137 on the exterior of subsection 35*b*. When excessive differential pressure is acting on valve closure means 31, movement of subsection 35*a* in the one direction compresses spring 39 which limits the force acting on valve closure means 31. When the differential pressure is equalized, spring 39 will cause subsection 35*b* to move longitudinally in the one direction which opens valve closure means 31 as shown in FIG. 3**.

When the fluid pressure in variable volume chamber 37 is decreased below a preselected value, spring 38 will move operating tube subsection **35*a* in the other direction. Subsections 35*a* and 35*b* are attached to each other such that movement of subsection 35*a* in the other direction also moves subsection 35*b* in the other direction. This movement allows valve closure means 31 to return to its first or closed position as shown in FIG. 2. A more detailed description of this type of safety valve is contained in co-pending U.S. patent application Ser. No. 214,041 now U.S. Pat. No. 4,376,464. However, a wide variety of flapper type safety valves can be easily modified to function satisfactorily with well tool 40**.

Figure 5A:
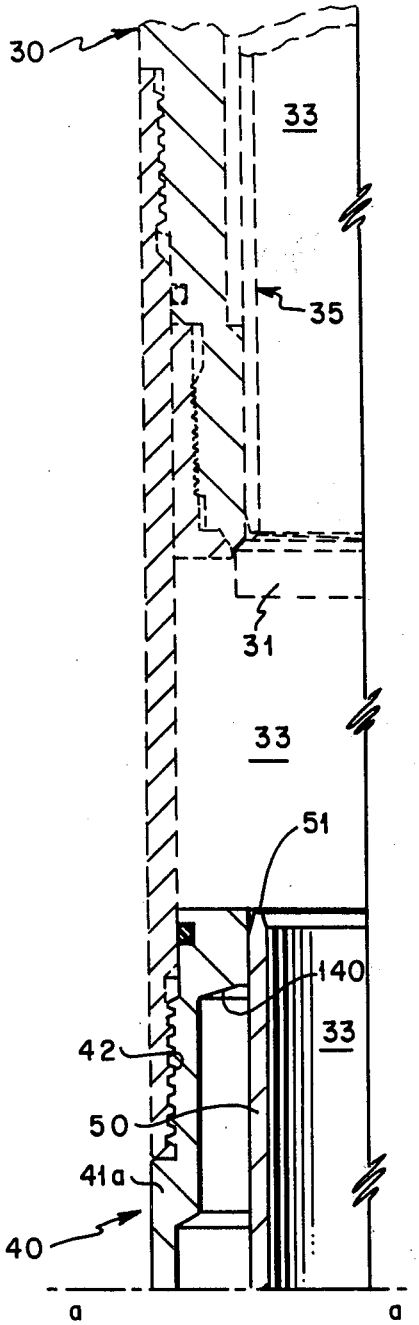
FIGS. 5A, B, and C are drawings in longitudinal section showing a well tool in its first position which does not affect operation of the safety valve to which the well tool is attached.
Figure 6A:
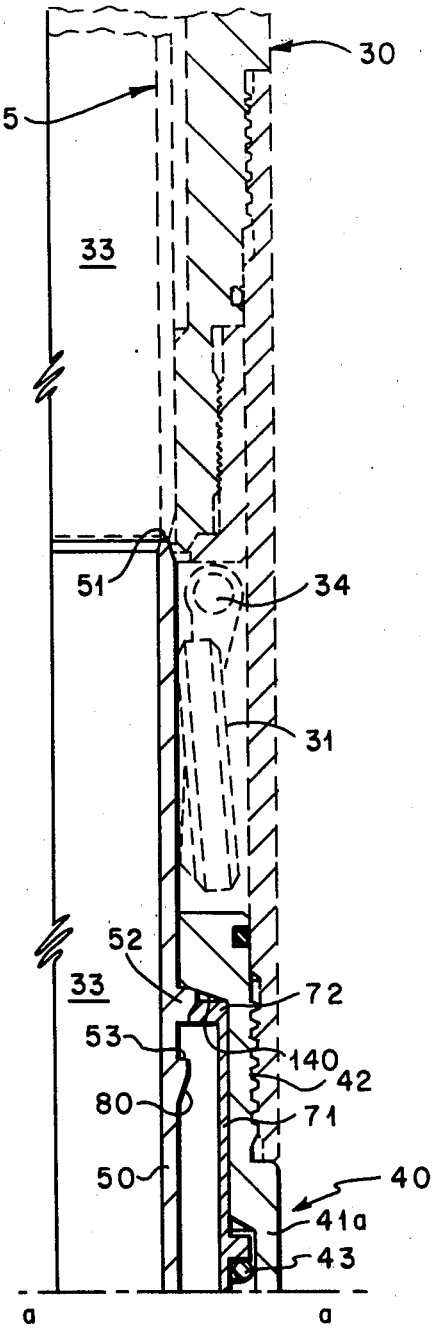
FIGS. 6A, B, and C are drawings in longitudinal section showing the well tool of FIGS. 5A–C in its second position which locks open the valve closure means of the safety valve to which the well tool is attached.
Figure 5B:
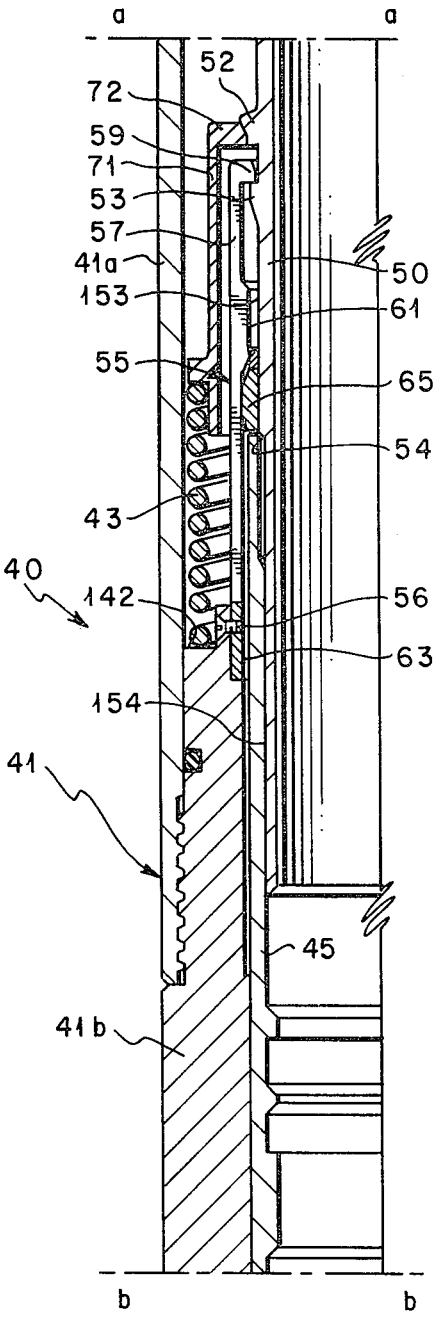

Well tool 40 comprises housing means 41 which is attached to and concentrically aligned with housing means 32. Longitudinal passageway 33 is partially defined by the interior of housing means 41 and extends longitudinally therethrough. If desired, housing means 32 and 41 could be manufactured as a single unit. However, well tool 40 is preferably a separate unit attached to the lower end of its associated safety valve by threads 42 as shown in FIGS. 5A and 6A. For ease of manufacture and assembly, housing means 41 comprises two concentrically aligned, hollow subsections **41*a* and 41*b***.

Well tool 40 includes four major components—lock-open sleeve 50, sliding sleeve 45, spring 43, and collet finger assembly 55. Lock-open sleeve 50 and sliding sleeve 45 are essentially hollow tubes which partially define longitudinal passageway 33 and are slidably disposed within housing means 41. Collet finger assembly 55 comprises part of the means for releasably securing lock-open sleeve 50 in its first position and will be described in more detail. Spring 43 provides means for biasing lock-open sleeve 50 to move from its first to its second position.

The portion of lock-open sleeve 50 furthest from valve closure means 31 is sized to slide within the inside diameter of sliding sleeve 45. Therefore, a portion of lock-open sleeve 50 is telescoped partially into sliding sleeve 45 and allows longitudinal movement of the two components relative to each other. Sliding sleeve 45 carries means for contacting collet finger assembly 55 and thereby releases lock-open sleeve 50 from its first position.

Figure 7:
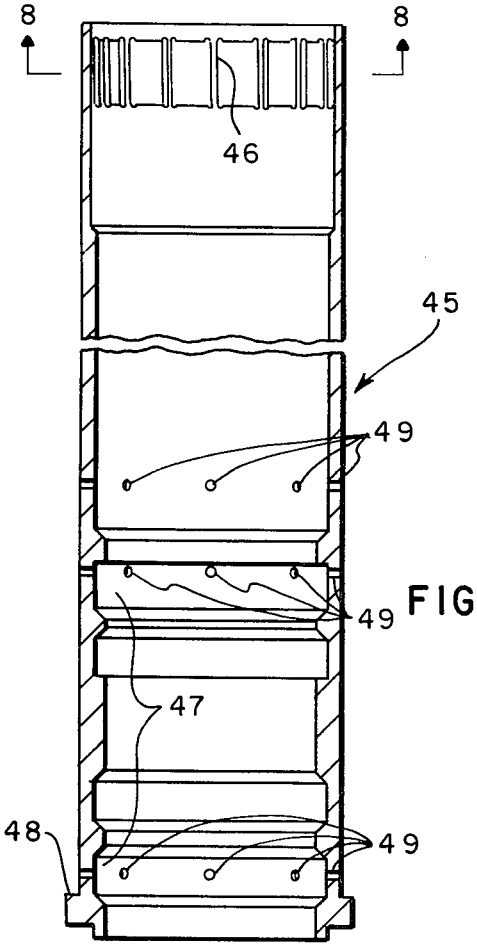
FIG. 7 is a drawing in longitudinal section of the sliding sleeve disposed within the well tool of FIGS. 5A–C.
Figure 8:
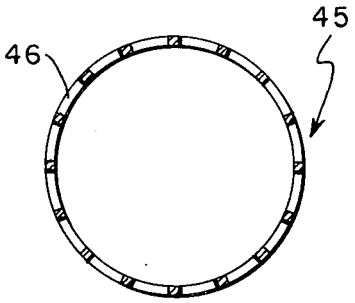
FIG. 8 is a drawing in radial section taken along line 8—8 of FIG. 7.
Figure 9:
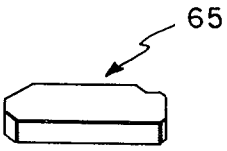
FIG. 9 is an orthographic projection of a lug carried by the sliding sleeve.

FIGS. 7 and 8 show sliding sleeve 45 in detail. A plurality of windows 46 is provided through the exterior of sleeve 45 near the end which telescopes over lock-open sleeve 50. A set of annular grooves or profile 47 is formed on the interior of sleeve 45 spaced longitudinally away from windows 46. As will be explained later, one lug 65 is carried in each window 46. Profile 47 is designed to be engaged by a conventional wireline shifting tool 70 to allow movement of sliding sleeve 45 longitudinally relative to lock-open sleeve 50. Shoulder or flange 48 is formed on the exterior of sleeve 45 near the end opposite from windows 46. An oppositely facing shoulder 141 is provided on the interior of housing means subsection **41*b*. Shoulders 48 and 141 cooperate to limit the longitudinal movement of sliding sleeve 45 towards valve closure means 31. Also, contact between shoulders 48 and 141 allows shifting tool 70 to be disengaged from sliding sleeve 45. A plurality of holes 49 extends radially through sleeve 45 in the vicinity of profile 47. Holes 49 ensure equalization of fluid pressures as shifting tool 70 is engaged with profile 47 and during longitudinal movement of sleeve 45. Holes 49 also minimize the possibility of sand or other debris interfering with the movement of sleeve 45**.

FIGS. 2, 3 and 4 show only a schematic representation of lock-open sleeve 50. FIGS. 5A and B and 6A and B show more of the details of lock-open sleeve 50 as actually manufactured. Extreme end 51 of lock-open sleeve 50, which is closest to valve closure means 31, is designed to abut operating tube 35 of the associated safety valve 30 when lock-open sleeve 50 is in its second position.

Lock-open sleeve 50 has a relatively uniform inside diameter extending completely therethrough. The outside diameter of lock-open sleeve 50 has several discontinuities and projections extending radially therefrom which facilitate proper functioning of sleeve 50. The first such projection spaced longitudinally from end 51 is first shoulder 52. For ease of manufacture and assembly, first shoulder 52 has an outside diameter larger than any of the other projections from sleeve 50. Hollow cylinder 71 surrounds lock-open sleeve 50 and has one end 72 which abuts first shoulder 52. The inside diameter of hollow cylinder 71 is significantly larger than the outside diameter of sleeve 50. This difference in diameters is required to position collet finger assembly 55 between sleeve 50 and cylinder 71.

First shoulder 52 serves two purposes within well tool 40. The first function is to provide a contact for cylinder 71. The second function is to limit the longitudinal movement of lock-open sleeve 50 as it moves towards valve closure means 31. First shoulder 140 on the interior of housing means subsection 41*a* faces first shoulder 52 on the exterior of lock-open sleeve 50. The second position for lock-open sleeve 50 is defined by contact between shoulders 52 and 140 in addition to contact between operating tube 35 and end 51. Spring 43 is disposed between the other end of hollow cylinder 71 and second shoulder 142 on the interior of housing means 41. As previously noted, spring 43 biases lock-open sleeve 50 to shift from its first to its second position.

Enlarged shoulder or second shoulder 53 is the next projection from the exterior of sleeve 50 spaced longitudinally from first shoulder 52. Collet finger assembly 55 releasably secures lock-open sleeve 50 in its first position by engaging enlarged shoulder 53. Collet finger assembly 55 is connected to the interior of housing means subsection 41*b* by screws 56.

Figure 10:
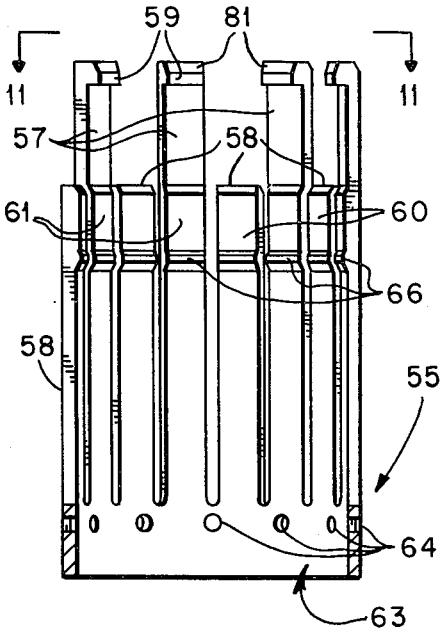
FIG. 10 is a drawing partially in elevation and partially in section showing the collet fingers which releasably secure the lock-open sleeve in its first position.
Figure 11:
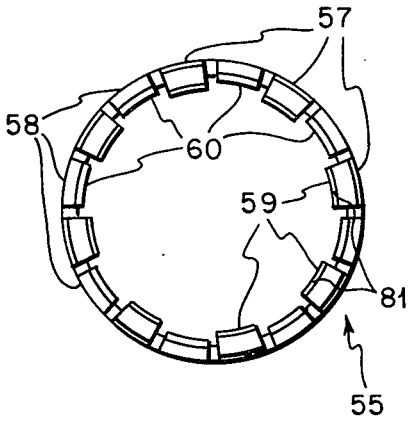
FIG. 11 is an end view of the collet fingers taken along line 10—10 of FIG. 10.

As best shown in FIGS. 10 and 11, collet finger assembly 55 is manufactured from a hollow cylinder. Two different sets of collet fingers 57 and 58 are provided thereon by machining longitudinal slots partially through the exterior assembly 55. Fingers 57 are longer than fingers 58 and are interposed radially between each other around the circumference of assembly 55. Threaded holes 64 are provided in the non-slotted portion of assembly 55 to receive screws 56 and secure assembly 55 to housing means subsection 41*b*. Preferably, every other hole 64 is left open to allow fluid flow around collet finger assembly 55 and prevent sand accumulation.

Each collet finger 57 has a collet head or hook 59 which projects radially inward towards sleeve 50. Collet heads 59 are designed to engage enlarged shoulder 53 when sleeve 50 is in its first position. Collet assembly 55 can function satisfactorily with only collet fingers 57. However, collet fingers 58 are preferably included to establish a significant difference in the force required to release lock-open sleeve 50 from its first position as compared to the force required to reengage collet heads 59 with enlarged shoulder 53. Sliding sleeve 45 provides part of the means for contacting collet fingers 57 to release sleeve 50 from its first position. Inside diameter 63 of assembly 55 is selected to allow unrestricted movement of sliding sleeve 45 between the exterior of lock-open sleeve 50 and the interior of collet finger assembly 55.

Each first collet finger 57 has an internal boss 61 projecting radially inward intermediate the ends thereof. A similar boss 60 is provided on the end of each second collet finger 58 located radially adjacent to each boss 61 on its respective first collet finger 57. Both bosses 60 and bosses 61 project radially inward the same distance as compared to inside diameter 63. Each boss 60 and 61 has a detent 66 projecting radially inward near the lower end of each boss. As previously noted, lugs 65 are carried in windows 46 of sliding sleeve 45.

The outside diameter of lock-open sleeve 50 adjacent to enlarged shoulder 53 is bigger than the outside diameter of the remainder of lock-open sleeve 50. The enlarged outside diameter portion is designated 153 and the reduced outside diameter portion is designated 154. The transition between these two portions 153 and 154 forms third shoulder 54 on the exterior of lock-open sleeve 50. Enlarged outside diameter portion 153 is sized such that when sliding sleeve 45 moves longitudinally upward relative to lock-open sleeve 50, lugs 65 are projected radially outward from their respective window 46. Bosses 60 and 61 are sized to contact lugs 65 when they are projected outward. Thus, upward longitudinal movement of sliding sleeve 45 will cause both first collet fingers 57 and second collet fingers 58 to flex radially outward. This movement of first collet fingers 57 releases collet heads 59 from enlarged shoulder 53 and allows spring 43 to shift lock-open sleeve 50 from its first to its second position.

OPERATING SEQUENCE

The normal operating position for lock-open sleeve 50 is shown in FIG. 2 and FIGS. 5A and B. Control fluid pressure can be supplied from conduit 26 to variable volume fluid chamber 37. When sufficient fluid pressure is present in chamber 37 to overcome the force of spring 38 and any well fluid pressure acting on piston means 36, operating tube 35 will move longitudinally towards valve closure means 31. If there is no difference in fluid pressure across valve closure means 31 or if the difference in fluid pressure generates a force less than the force of spring 39, this longitudinal movement of operating tube 35 will shift valve closure means 31 from its first to its second position allowing fluid flow through longitudinal passageway 33. When necessary to block well fluid flow through tubing 21, control fluid pressure in chamber 37 is decreased by decreasing fluid pressure in control line 26. When the force of spring 38 and well fluid pressure acting on piston means 36 exceeds the force of control fluid pressure acting on piston means 36, operating tube 35 will move longitudinally in the other direction allowing valve closure means 31 to return to its first position. During this normal operation of safety valve 30, lock-open sleeve 50 remains releasably secured in its first position by engagement of hooks 59 with enlarged shoulder 53.

While performing well maintenance or testing such as a bottom hole pressure survey, it is desirable to temporarily lock open safety valve 30. Valve closure means 31 must be in its second position to allow a wireline tool string to be lowered therepast. If valve closure means 31 should accidentally return to its first position during wireline maintenance or testing, both the tool string and the safety valve may be seriously damaged. The cost of repairing such damage can be very expensive and result in the loss of significant petroleum production. Therefore, recommended operating procedures require that a subsurface safey valve be mechanically locked open when conducting wireline work below the valve.

FIG. 3 shows an intermediate step in the procedure which allows lock-open sleeve 50 to shift from its first to its second position and temporarily lock open valve closure means 31. When necessary to conduct wireline work in tubing 21, valves 23 and 24 are shut at the well surface, wellhead cap 27 removed, and conventional wireline service equipment including a lubricator (not shown) is attached thereto. Valve closure means 31 is shifted to its second position by applying control fluid pressure to chamber 37. Wireline 71 with shifting tool 70 attached thereto can be lowered through tubing 21 and longitudinal passageway 33 by standard procedures until tool 70 engages profile or locking grooves 47 in sliding sleeve 45. Various well tools and profiles are commercially available and frequently used to slide a sleeve longitudinally in a well bore.

After shifting tool 70 is engaged with profile 47, upward force is applied to wireline 71 which causes sliding sleeve 45 to move longitudinally towards valve closure means 31. This same movement results in shifting sleeve 45 being telescoped over the exterior of lock-open sleeve 50. When lugs 65 contact the enlarged outside diameter portion 153, they are projected radially outward through their respective windows 46. Bosses 60 and 61 project radially inward a sufficient amount to prevent unrestricted upward movement of sliding sleeve 45 when lugs 65 are projected radially outward. When sufficient force is applied to wireline 71, both first collet fingers 57 and second collet fingers 58 will be flexed radially outward by the contact between bosses 60 and 61, sliding sleeve 45, profile 47, and shifting tool 70. Outward flexing of first collet fingers 57 releases hook 59 from its engagement with enlarged shoulder 53. FIG. 3 shows collet fingers 57 and lock-open sleeve 50 in this intermediate position.

After lock-open sleeve 50 is released from its first position, spring 43 moves sleeve 50 upwards until extreme end 51 abuts or contacts operating tube 35. Control fluid pressure in chamber 37 is then decreased allowing spring 39 to move operating tube 35 upward. Lugs 65 can rest on detent 66 until after control pressure in chamber 37 is released. Lugs 65, bosses 60 and 61, and detent 66 cooperate to prevent reengagement of hooks 59 with enlarged shoulder 53. As previously noted, decreasing control fluid pressure would normally result in valve closure means 31 returning to its first or closed position. However, since spring 43 is now holding lock-open sleeve 50 in close contact with operating tube 35, both sleeve 50 and operating tube 35 move longitudinally upward as a single unit. This movement results in valve closure means 31 remaining trapped by lock-open sleeve 50 in its second position as shown in FIGS. 4 and 6A. Operating tube 35 is not used to hold open valve closure means 31.

Figure 6B:
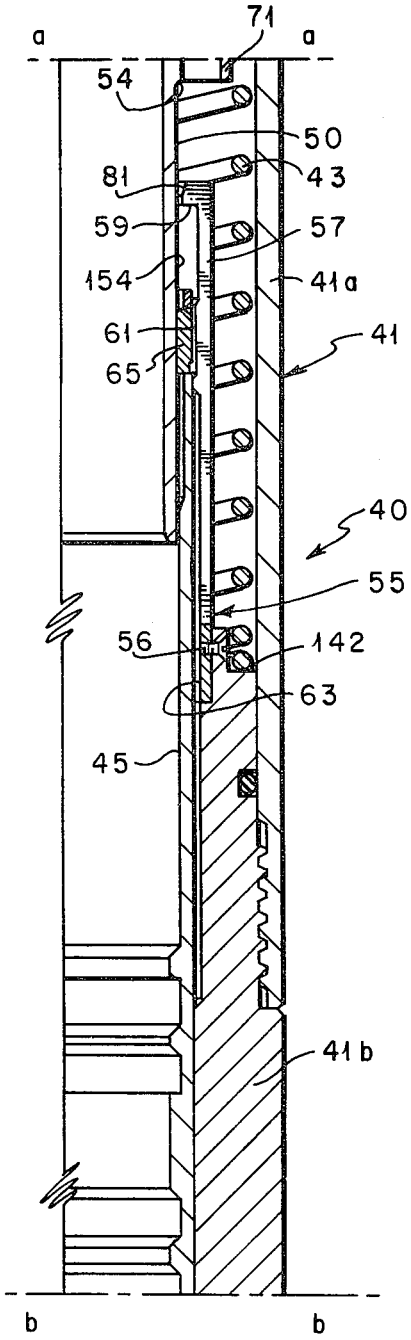
Figure 5C:
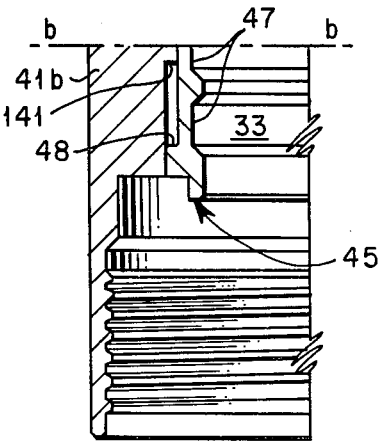
Figure 6C:
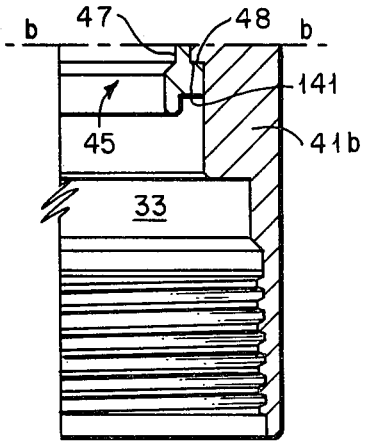

The upward movement of lock-open sleeve 50 is limited by first shoulder 52 contacting shoulder 140 of housing means 41*a*. The longitudinal position of first shoulder 52 on the exterior of lock-open sleeve 50 is selected relative to reduced outside diameter portion 154 such that lugs 65 are radially adjacent thereto when lock-open sleeve 50 is in its second position. This positioning of reduced outside diameter portion 154 allows collet fingers 57 and 58 to return to their relaxed position and project lugs 65 radially inward as shown in FIG. 6B.

The upward movement of sliding sleeve 45 is limited by contact between shoulders 48 and 141 which allows tool 70 to be disengaged from profile 47. Wireline work can now be conducted below safety valve 30 without having to maintain control fluid pressure in chamber 37 to hold valve closure means 31 open.

Safety valve 30 and well tool 40 can be returned to their normal operating condition by merely applying sufficient control fluid pressure to chamber 37 after the wireline work has been completed. As previously explained, increased control fluid pressure in chamber 37 causes operating tube 35 to move longitudinally in the one direction. For the particular embodiment shown in FIGS. 2, 3 and 4, spring 43 is selected such that it can be compressed by less force than spring 39. Therefore, movement of operating tube 35 in one direction causes lock-open sleeve 50 to move in the one direction. As previously noted, lugs 65 are projected radially inward against reduced outside diameter portion 154. Therefore, third shoulder 54 will contact lugs 65 and return sliding sleeve 45 to its initial position. Note: The weight of sliding sleeve 45 may have automatically returned it to its initial position after disengagement of shifting tool 70.

Movement of lock-open sleeve 50 in the one direction by operating tube 35 causes enlarged shoulder 53 to contact hooks or collet heads 59. Shoulder 53 and hooks 59 have appropriately tapered surfaces 80 and 81 to assist in flexing first collet fingers 57 radially outward. This outward flexing results in hooks 59 reengaging shoulder 53 and releasably securing lock-open sleeve 50 in its first position. Second collet fingers 58 are not disturbed during this reengagement of hooks 59 and shoulder 53. Therefore, significantly less force is required to return lock-open sleeve 50 to its first position as compared to the force which must be applied to sliding sleeve 45 to release lock-open sleeve 50 from its first position. The selection of spring 43 as compared to spring 39 and the force required to flex only first collet fingers 57 is important for those safety valves which have a multiple section, telescoping operating tube. For those safety valves which have a solid, single piece operating tube, the selection of spring 43 and flexing only first collet fingers 57 is a critical design requirement. However, it is always preferable to require that a significant amount of force be applied to sliding sleeve 45 before lock-open sleeve 50 can be released. This feature of the present invention reduces the possibility of accidentally locking open safety valve 30.

ALTERNATE EMBODIMENTS

As previously noted, housing means 32 and 41 could be combined together as a single unit if desired. This would result in the lock-open mechanism of the present invention becoming an integral part of the safety valve.

The present invention could be easily modified to permanently lock open valve closure means 31 if desired. One way to accomplish permanent lock-open would be to replace third shoulder 54 and reduced outside diameter portion 154 with an annular groove on the exterior of lock-open sleeve 50 sized to receive lugs 65. If lugs 65 and the new annular groove had adjacent square shoulders, lock-open sleeve 50 would be trapped in its second position whenever lugs 65 engaged the new annular groove. Those skilled in the art will readily see other locations for detent mechanisms which would trap lock-open sleeve 50 in its second position.

The previous description and drawings were made with reference to a flapper type valve closure means. The present invention could be readily adapted to lock open a ball type valve closure means by sizing extreme end 51 to fit within the opening through the ball member. Lock-open sleever 50 would than act as a prop preventing the ball member from rotating to its closed position.

The previous description is illustrative of only some of the embodiments of the invention. Those skilled in the art will readily see other variations for a well tool to lock open subsurface safety valves utilizing the present invention. Changes and modifications may be made without departing from the scope of the invention which is defined by the claims.

What is claimed is:

1. A well tool for locking open the valve closure means of a surface controlled subsurface safety valve, comprising:

a. housing means with a longitudinal passageway extending therethrough;

b. means for attaching the housing means to the safety valve below its valve closure means;

c. a lock-open sleeve slidably disposed in the longitudinal passageway having a first position which does not affect operation of the valve closure means and a second position which holds the valve closure means in its open position;

d. means for releasably securing the lock-open sleeve in its first position;

e. means for biasing the lock-open sleeve to shift from its first to its second position;

f. a sleeve slidably disposed in the longitudinal passageway;

g. a portion of the lock-open sleeve telescoped partially into the sliding sleeve; and h. means for contacting the releasable securing means by the sliding sleeve whereby the lock-open sleeve is released from its first position.

2. A well tool as defined in claim 1 wherein the releasable securing means further comprises:

a. flexible collet fingers attached to the interior of the housing means between the outside diameter of the lock-open sleeve and the interior of the housing means;

b. a collet head on selected collet fingers projecting radially inward towards the lock-open sleeve; and c. an enlarged shoulder on the exterior of the lock-open sleeve intermediate the ends thereof and engageable with the collet heads to releasably secure the lock-open sleeve in its first position.

3. A well tool as defined in claim 2 further comprising means for contacting the collet fingers by the sliding sleeve to release the engagement between the collet heads and the enlarged shoulder.

4. A well tool as defined in claim 2 wherein the contacting means comprises:

a. a plurality of windows extending radially through the sliding sleeve;

b. a lug slidably disposed in each window;

c. a boss on each collet finger projecting radially inward;

d. an enlarged outside diameter portion on the lock-open sleeve spaced radially adjacent to the flanges;

e. the sliding sleeve slidably disposed between the lock-open sleeve and the collet fingers; and f. the enlarged outside diameter portion sized to project the lugs radially outward from their respective windows to contact the associated boss and flex the collet fingers radially outward releasing the lock-open sleeve from its first position.

5. A surface controlled subsurface safety valve having a housing means with a longitudinal passageway extending therethrough, a valve closure means disposed in the longitudinal passageway having a first position blocking fluid flow therethrough and a second position allowing fluid flow through the longitudinal passageway, and an operating tube means slidably disposed in the longitudinal passageway to shift the valve closure means from its first to its second position, comprising:

a. a lock-open sleeve slidably disposed in the longitudinal passageway having a first position which does not affect operation of the valve closure means and a second position which holds the valve closure means in its second position;

b. the valve closure means located between the operating tube means and the lock-open sleeve;

c. means for releasably securing the lock-open sleeve in its first position;

d. the operating tube means engageable with the lock-open sleeve to shift the lock-open sleeve longitudinally from its second to its first position;

e. means for biasing the lock-open sleeve to shift from its first to its second position;

f. a sliding sleeve slidably disposed in the longitudinal passageway;

g. a portion of the lock-open sleeve telescoped partially into the sliding sleeve; and h. means for contacting the releasable securing means by the sliding sleeve whereby the lock-open sleeve is released from its first position.

6. A safety valve as defined in claim 5 further comprising a flapper type valve closure means.

7. A safety valve as defined in claim 5 wherein the releasable securing means comprises:

a. flexible collet fingers connected to the housing means;

b. a collet head on the end of selected fingers with each collet head projecting radially inward towards the lock-open sleeve;

c. an enlarged shoulder on the exterior of the lock-open sleeve intermediate the ends thereof which is engaged by the collet heads when the lock-open sleeve is in its first position; and d. the collet heads reengageable with the enlarged shoulder after shifting the lock-open sleeve from its second to its first position.

8. A safety valve as defined in claim 5 wherein the biasing means comprises:

a. a first shoulder on the exterior of the lock-open sleeve;

b. a hollow cylinder surrounding the lock-open sleeve with an inside diameter larger than the outside diameter of the sliding sleeve;

c. the hollow cylinder with one end abutting the first shoulder;

d. a second shoulder formed on the interior of the housing means facing the other end of the hollow cylinder; and e. a spring disposed between and contacting both the hollow cylinder and the second shoulder.

9. A safety valve as defined in claim 5 further comprising:

a. flexible collet fingers attached to the interior of the housing means between the outside diameter of the lock-open sleeve and the interior of the housing means;

b. a collet head on selected collet fingers projecting radially inward towards the lock-open sleeve;

c. an enlarged shoulder on the exterior of the lock-open sleeve intermediate the ends thereof; and d. engagement between the collet heads and the enlarged shoulder releasably securing the lock-open sleeve in its first position.

10. A safety valve as defined in claim 5 further comprising:

a. a sliding sleeve slidably disposed within the longitudinal passageway between the exterior of the lock-open sleeve and the collet fingers;

b. a portion of the sliding sleeve being engageable by a shifting tool within the longitudinal passageway whereby the sliding sleeve can be moved longitudinally relative to the collet fingers;

c. means for contacting the collet fingers by the sliding sleeve to release the lock-open sleeve from its first position; and d. means for limiting the longitudinal movement of the sliding sleeve within the longitudinal passageway whereby the shifting tool can be disengaged from the sliding sleeve.

11. A safety valve as defined in claim 10 further comprising:

a. a plurality of windows extending radially through the sliding sleeve;

b. a lug slidably disposed in each window;

c. a boss on each collet finger projecting radially inward;

d. an enlarged outside diameter portion on the lock-open sleeve spaced radially adjacent to the flanges; and e. the enlarged outside diameter portion sized to project the lugs radially outward from their respective windows to contact the associated boss and flex the collet fingers radially outward releasing the lock-open sleeve from its first position.

12. A safety valve as defined in claim 11 further comprising a reduced outside diameter portion on the lock-open sleeve, adjacent to the lugs when the lock-open sleeve is in its second position, whereby the collet fingers can project the lugs radially inward through their respective windows.

13. A safety valve as defined in claim 12 further comprising:

a. a third shoulder formed on the exterior of the lock-open sleeve by the transition from the enlarged outside diameter portion which projects the lugs radially outward and the reduced outside diameter portion which allows the lugs to be projected radially inward; and b. the third shoulder sized to contact the lugs and to return the sliding sleeve to its initial position while sliding the lock-open sleeve longitudinally from its second to its first position.

14. An improved surface controlled subsurface safety valve having a housing means with a longitudinal passageway extending therethrough, a valve closure means disposed in the longitudinal passageway having a first position blocking fluid flow therethrough and a second position allowing fluid flow through the longitudinal passageway, an operating tube means slidably disposed in the longitudinal passageway to shift the valve closure means from its first to its second position, wherein the improvement comprises:

a. a lock-open sleeve slidably disposed in the longitudinal passageway having a first position which does not affect operation of the valve closure means and a second position which holds the valve closure means in its second position;

b. the valve closure means located between the operating tube means and the lock-open sleeve;

c. first flexible collet fingers attached to the interior of the housing means between the outside diameter of the lock-open sleeve and the interior of the housing means;

d. a collet head on the end of each first finger projecting radially inward towards the lock-open sleeve;

e. an enlarged shoulder on the outside diameter of the lock-open sleeve intermediate the ends thereof whereby engagement between the collet heads and the enlarged shoulder releasably secures the lock-open sleeve in its first position;

f. wherein said valve closure means is a flapper type valve; and g. the operating tube means abutting the lock-open sleeve to shift the lock-open sleeve from its second to its first position.

15. A safety valve as defined in claim 15 further comprising:

a. a sliding sleeve slidably disposed in the longitudinal passageway;

b. a portion of the lock-open sleeve telescoped partially into the sliding sleeve; and c. means for contacting the first collet fingers by the sliding sleeve to release the lock-open sleeve from its first position.

16. A safety valve as defined in claim 15 wherein the contacting means comprises:

a. a plurality of windows extending radially through the sliding sleeve;

b. a lug slidably disposed in each window;

c. a boss on each first finger intermediate the ends thereof and projecting radially inward;

d. an enlarged outside diameter portion on the lock-open sleeve spaced radially adjacent to the flanges;

e. the sliding sleeve slidably disposed between the lock-open sleeve and the collet fingers; and f. the enlarged outside diameter portion sized to project the lugs radially outward from their respective windows to contact the associated boss and flex the first fingers radially outward releasing the lock-open sleeve from its first position.

17. A safety valve as defined in claim 16 wherein the releasable securing means comprises:

a. second collet fingers attached to the interior of the housing means between the outside diameter of the lock-open sleeve and the interior of the housing means;

b. the second collet fingers interposed between the first collet fingers and having a shorter length as compared to the first collet fingers;

c. a boss on the end of each second collet finger located radially adjacent to the boss on each first collet finger whereby the lug must flex both the first and second collet finger radially outward to release the lock-open sleeve from its first position; and d. the difference in length between the first and second collet fingers results in only the first collet fingers being flexed radially outward during reengagement of the collet heads with the enlarged shoulder on the exterior of the lock-open sleeve.

* * * * *